US005574701A

United States Patent [19]

Harilela

[11] Patent Number: 5,574,701

[45] Date of Patent: Nov. 12, 1996

[54] MARBLE WATCH

[75] Inventor: Mangharam Harilela, Kowloon Tong, Hong Kong

[73] Assignee: HBL Limited, Kowloon, Hong Kong

[21] Appl. No.: 547,790

[22] Filed: Oct. 25, 1995

[51] Int. Cl.[6] ..... G04B 19/00; G04B 37/00

[52] U.S. Cl. ..... 368/223; 368/276; 368/285

[58] Field of Search ..... 368/10, 45, 223, 368/228, 229, 276, 278, 285, 82–84, 239–241, 299–300

[56] References Cited

U.S. PATENT DOCUMENTS

| | | | |
|---|---|---|---|
| 3,964,748 | 6/1976 | Harvey, Jr. | 273/138 R |
| 4,120,116 | 10/1978 | Williams | 46/1 R |
| 4,720,283 | 1/1988 | Williams et al. | 446/69 |
| 5,314,181 | 5/1994 | Lin | 233/109 |

*Primary Examiner*—Vit W. Miska
*Attorney, Agent, or Firm*—Jacobson, Price, Holman & Stern, PLLC

[57] ABSTRACT

A timepiece is included in a marble which is rotatably mounted on a watchcase. The marble is easily removed from the watchcase to be usable in all games that require a marble. The timepiece may be a liquid crystal diode (LCD) movement which is encompassed between two half sections of the marble which are threadingly secured together. The marble is placed in a recess on the face of the watchcase and secured in place by a removably mounted semi-spherical shaped lens. The lens has an opening through which a surface of the marble is exposed for rotation of the marble in all directions. The marble is rotated by a finger of the watch wearer contacting the marble and spinning the marble as the marble is held in place by the lens. At least one portion of the marble is transparent to allow viewing of the time from the LCD watch movement. The transparent portion of the marble may include a magnifying lens so as to enlarge the digital display of the LCD watch movement.

18 Claims, 3 Drawing Sheets

MARBLE WATCH

FIELD OF THE INVENTION

This invention relates to the inclusion of a timepiece in a marble with the marble being rotatably mounted between a lens and a watchcase so that the marble is rotatable on the watchcase.

BACKGROUND OF THE INVENTION various novelty watches are available in the marketplace which include a specific function. Usually however, the components of the watch are maintained in the watchcase or on the strap of the watch.

SUMMARY OF THE INVENTION

By the present invention, a timepiece is included in a marble which is rotatably mounted on a watchcase. The marble is easily removed from the watchcase to be usable in all games that require a marble. The timepiece may be a liquid crystal diode (LCD) movement which is encompassed between two half sections of the marble which are threadingly secured together.

The marble is placed in a recess on the face of the watchcase and secured in place by a removably mounted semi-spherical shaped lens. The lens has an opening through which a surface of the marble is exposed for rotation of the marble in all directions. The marble is rotated by a finger of the watch wearer contacting the marble and spinning the marble as the marble is held in place by the lens.

At least one portion of the marble is transparent to allow viewing of the time from the LCD watch movement. The transparent portion of the marble may include a magnifying lens so as to enlarge the digital display of the LCD watch movement. Additional portions of the exterior surface of the marble may include printed graphics for advertising or other display purposes. If, for example, the printed graphics are included on a side of the marble opposite to the display of the watch movement, the graphics would be prominently displayed upon rotation of the marble through 180° of rotation.

The two marble sections are screwed together to contain the LCD watch movement therebetween. The sections of the marble are hollow and include recesses for receipt of the LCD watch movement. The two marble sections also include cavities for holding other small accessory items such as an earring.

The sections of the marble can be opened to gain access to the watch movement to set the time or to replace the battery in the LCD watch movement. In addition, upon opening the marble, access is gained to the small accessory items which are contained therein.

The lens is locked to the watchcase by biased prongs. Once the lens is secured in place, the marble rests in a spherical depression of the watchcase and an opposite surface of the marble protrudes from the opening in the lens. The marble is thereby able to be rotated in every direction and spun within the lens. The marble is released by removal of the lens, to be available for play in any standard marble game.

Accordingly, it is an object of the present invention to provide a watchcase having a lens secured thereto with a marble secured between the lens and the watchcase for rotation of the marble by engagement with the surface of the marble projecting through the lens.

It is another object of the present invention to provide a watchcase having a lens secured thereto with a marble secured between the lens and the watchcase for rotation of the marble by engagement with the surface of the marble projecting through the lens and having a LCD watch movement contained within the marble.

It is yet another object of the present invention to a watchcase having a lens secured thereto with a marble secured between the lens and the watchcase for rotation of the marble by engagement with the surface of the marble projecting through the lens and having a LCD watch movement contained within the marble with the marble including a cavity for containing an accessory item.

It is another object of the present invention to provide a watchcase having a lens secured thereto with a marble secured between the lens and the watchcase for rotation of the marble by engagement with the surface of the marble projecting through the lens and having a LCD watch movement contained within the marble with the marble including a cavity for containing an accessory item and part of the marble being magnifier.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
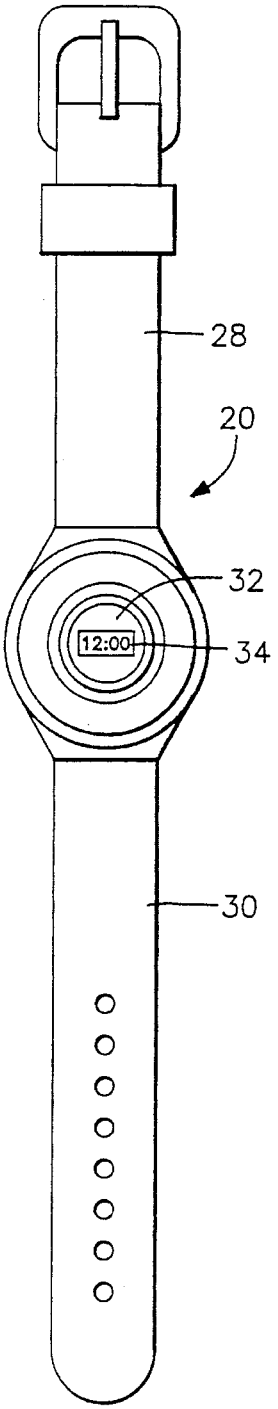
FIG. 1 is a plan view of a marble watch incorporating the features of the present invention having a securing strap with an LCD watch movement being displayed through an opening in a lens which secures a marble within which the LCD watch movement is located, to .the watchcase.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
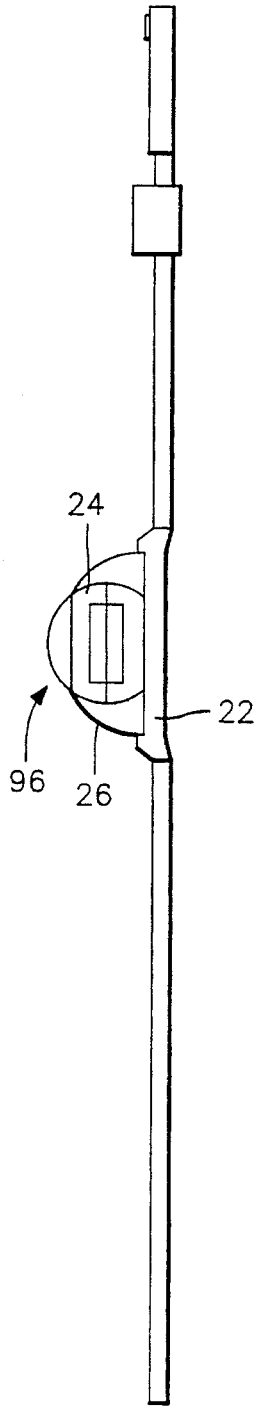
FIG. 2 is a side elevational view of the marble watch shown in FIG. 1.
Figure 3:
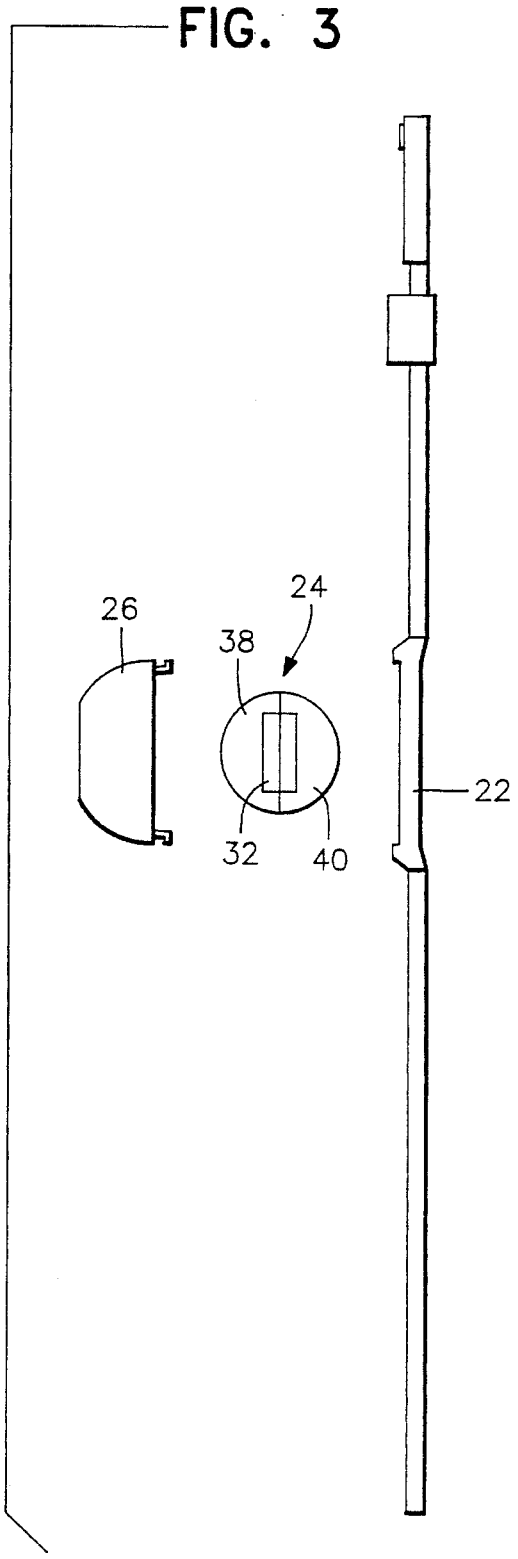
FIG. 3 is an exploded view of the watchcase and its strap, marble and semi-spherical lens which holds the marble to the watchcase.

With reference to the drawings, in general, and to FIG. 1 through 3, in particular, a marble watch embodying the teachings of the subject invention is generally designated as 20. With reference to its orientation in FIGS. 1 through 3, the marble watch comprises a watchcase 22, a marble 24 and a lens 26. The watchcase includes two straps 28 and 30 secured thereto for attaching the marble watch of the present invention to a wrist of a wearer.

Figure 4:
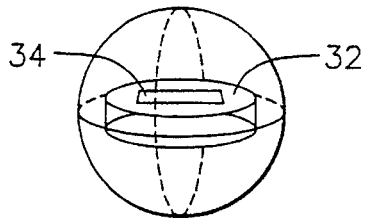
FIG. 4 is an enlarged view of the marble which contains an LCD watch movement.
Figure 5:
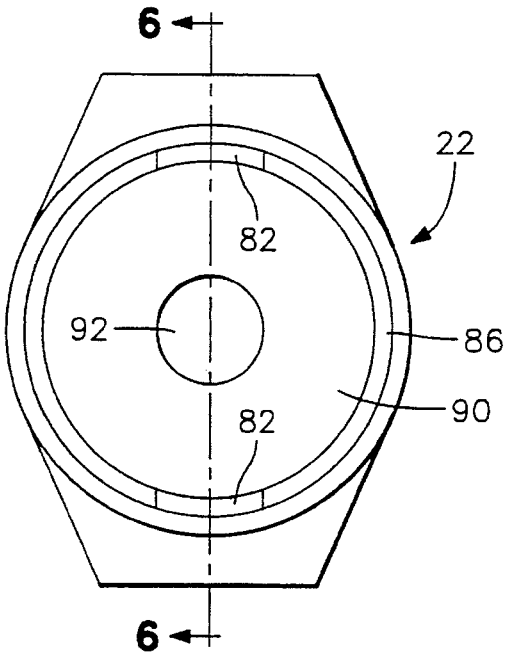
FIG. 5 is an enlarged view of the watchcase having partial spherical depression for receipt of a bottom surface of the marble when the marble is secured to the watchcase by the semi-spherical lens.
Figure 6:
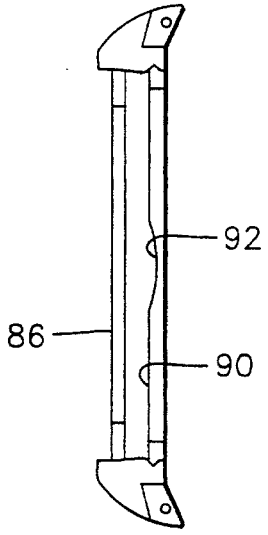
FIG. 6 is a sectional view taken along line 6—6 of FIG. 5
Figure 7:
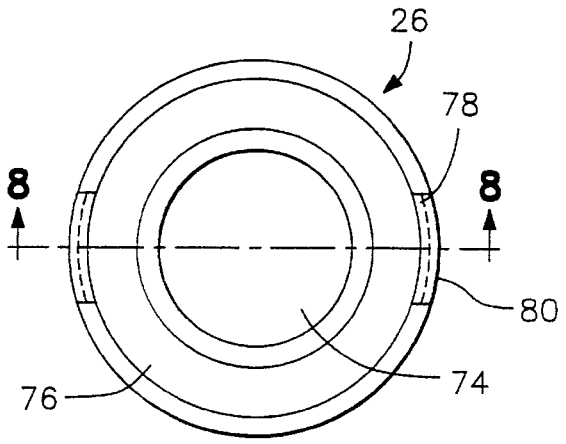
FIG. 7 is an enlarged plan view of the semi-spherical lens.
Figure 8:
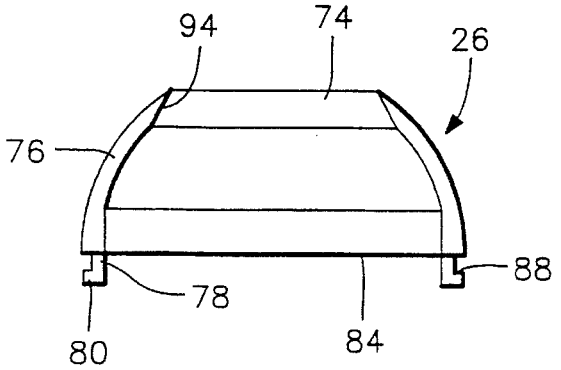
FIG. 8 is a sectional view taken along line 8—8 of FIG. 7.
Figure 11:
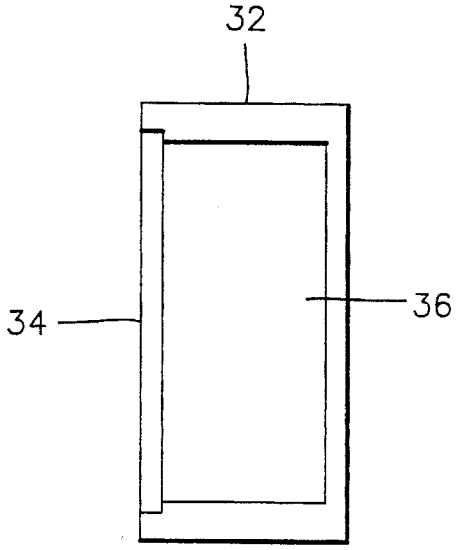
FIG. 11 is an enlarged sectional view of the LCD watch movement of the present invention.

With reference to FIG. 1, the marble 24 includes a LCD watch movement 32, having a digital display 34 indicative of the time of day. The LCD watch movement is in the form of a cylindrical button as best shown in FIG. 4. The details of the LCD watch movement are shown in FIG. 11 where the watch movement 32 includes LCD display 34 on an upper surface. Located below the upper removably mounted display 34 is a battery compartment 36, for receipt of a button battery for powering the LCD display 34.

Figure 9:
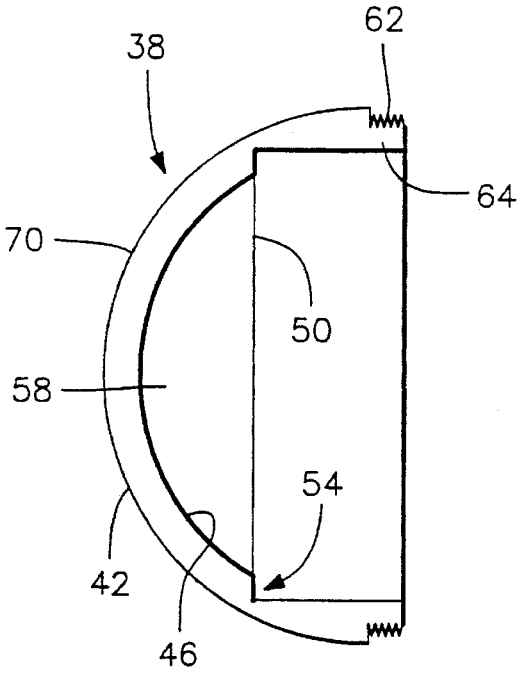
FIG. 9 is a sectional view of one of the two sections which are securable together to contain the marble containing the LCD watch movement.
Figure 10:
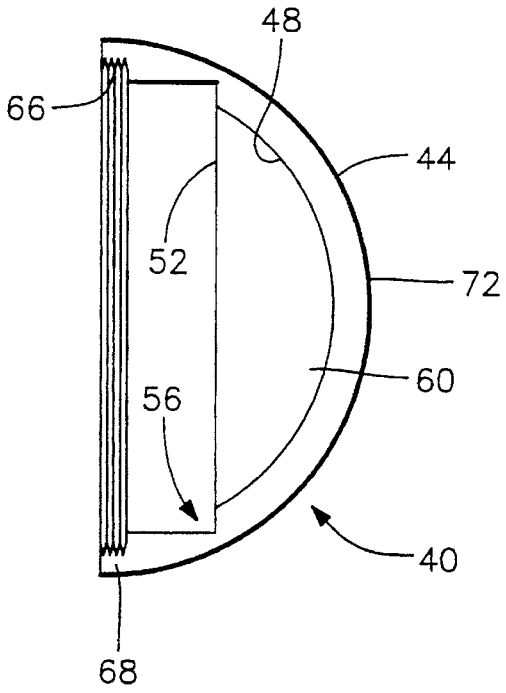
FIG. 10 is the other of the two sections of the marble which are securable together to form the marble of the present invention.

The marble 24 which houses the LCD watch movement 32, is formed of two sections 38 and 40 as shown in FIGS. 9 and 10, respectively. The two sections form a hollow cavity when assembled together and comprise exterior surfaces 42 and 44 and interior surfaces 46 and 48, respectively. Cut within an interior surface of each of the interior surfaces 46 and 48, is a stepped ledge 50 and 52, respectively, for engaging and seating the exterior surfaces of the LCD watch movement 32. The ledge 50 and 52 is cut only into the interior surfaces 46 and 48 so as to maintain the hollow form of the assembled sections 38, 40. In the sectional views of FIG. 9 and 10, the right angle cut 54 and 56 into the interior surfaces 46 and 48 supports the exterior of the LCD watch movement while providing additional hollow cavities 58 and 60 in sections 38, 40, respectively.

To secure the two sections 38, 40 to each other, a radially outwardly extending thread 62 extending from projection 64 engages with thread 66 extending radially inwardly from an annular ridge 68 of section 40. Once the two sections 38, 40 are threadingly engaged, the LCD watch movement is fixed in position within the thus formed marble 24. The two sections 38, 40 may be separated for access to the LCD watch movement 32 and also to store and/or retrieve items in cavities 58, 60.

For display of the watch movement 32 of the marble 24, one portion of one section 38, for example, may include a magnifying lens area 70 for enlarging the display of the digital time. Alternatively, both sections 38 and 30 could include a magnifying lens or be made entirely of a magnifying lens construction. It is also within the scope of the present invention that if lens area 70 of section 38 is a magnifying lens for enlarging the digital display of the LCD watch movement, a corresponding opposite area 72 of section 40 could include printed graphics or advertising display either on area 72 of section 40 or within cavity 60 and viewed through area 72 for either magnified or non-enlarged viewing of the graphics or display.

To secure the marble 24 to the marble watch 20, a lens 26, of a semi-spherical shape, has an opening 74 for protrusion therethrough of the marble 24. The semi-spherical side walls 76 of the lens terminate in opposed annular ridges 78 having radially outwardly extending feet 80 extending therefrom for securing the lens 26 to the watchcase 22.

Watchcase 22 includes openings 82 into which annular ridges 78 and feet 80 project so that a bottom edge 84 of lens 26 rests upon ledge 86 of the watchcase. Upon rotation of the lens 26, the ledge 86 is engaged between the surface 84 of the lens and the upper surface 88 of the radially outwardly projecting feet 80. The lens is thereby secured by a friction fit onto the case 22.

In the center of bottom surface 90 of the case 22 is spherical depression 92 for receipt of the lowermost surface of the marble 24. With the lens 26 secured to the watchcase 22, the marble is held in position between the side wall 94 of the opening 74 of the lens 26 at the marble's upper surface and located in the spherical depression 92 at the marble's lower surface. Due to the dimensioning of the separation between the opening 74 and the spherical depression 92, a surface 96 of the marble 24 projects beyond the lens 26. The wearer of the marble watch is thereby able to rotate the marble by engaging surface 96 and slowly rotating the marble or rapidly spinning the marble according to the wearer's preference.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A watch comprising:

a watchcase, a lens secured to said watchcase, and a marble rotatably mounted between said lens and said watchcase, said marble including a watch movement.

2. A watch as claimed in claim 1, wherein said marble is formed of two sections removably secured to each other.

3. A watch as claimed in claim 2, wherein said watch movement is located within said two sections.

4. A watch as claimed in claim 1, wherein said marble partially projects through said lens.

5. A watch as claimed in claim 1, wherein at least a portion of said marble magnifies a display of said watch movement.

6. A watch as claimed in claim 5, wherein said display includes digital numerals.

7. A watch as claimed in claim 1, wherein said watchcase includes a spherical depression for receipt of said marble.

8. A watch as claimed in claim 1, wherein said marble includes at least one cavity for receipt of accessories.

9. A watch as claimed in claim 1, wherein a strap is secured to said watchcase for positioning the watch on the wrist of a wearer.

10. A toy comprising:

a case, a lens secured to said case, and a marble partially projecting through said lens and rotatably mounted between said case and said lens, said marble being formed of two sections removably secured to each other, and a watch movement being located in said marble.

11. A toy as claimed in claim 10, wherein at least a portion of said marble magnifies a display of said watch movement.

12. A toy as claimed in claim 10, wherein said marble includes at least one cavity for receipt of accessories.

13. A toy as claimed in claim 10, wherein said lens is semi-spherical.

14. A toy as claimed in claim 10, wherein said case includes a spherical depression for receipt of said marble.

15. A watch comprising:

a watchcase, a semi-spherical lens secured to said watchcase, said lens including an opening, a marble rotatably mounted between said lens and said watchcase and projecting through said opening of said lens, and a watch movement contained with said marble.

16. A watch as claimed in claim 15, wherein said marble includes at least one cavity for receipt of accessories.

17. A watch as claimed in claim 15, wherein at least a portion of said marble magnifies a display of said watch movement.

18. A watch as claimed in claim 15, wherein said watchcase includes a spherical depression for receipt of said marble.

* * * * *